US006816689B1

(12) United States Patent
Rodriguez et al.

(10) Patent No.: US 6,816,689 B1
(45) Date of Patent: Nov. 9, 2004

(54) SYSTEMS AND METHODS FOR REDUCING ELECTROSTATIC MEMORY

(75) Inventors: Santiago Rodriguez, Boise, ID (US); Quintin T. Phillips, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/640,729

(22) Filed: Aug. 14, 2003

(51) Int. Cl.[7] ..... G03G 21/08
(52) U.S. Cl. ..... 399/128; 399/43
(58) Field of Search ..... 399/43, 51, 82, 399/83, 85, 128, 383

(56) References Cited

U.S. PATENT DOCUMENTS 4,264,186 A * 4/1981 Fujiwara et al. ..... 399/160

* cited by examiner

*Primary Examiner*—Hoang Ngo

(57) ABSTRACT

Disclosed are systems and methods for reducing the creation of electrostatic memory. In one embodiment, a system and a method pertain to determining whether print content is to be repeated across consecutive pages, and if the print content is to be repeated, controlling a print engine of the imaging device to reduce electrostatic memory on a photoconductor member of the print engine.

39 Claims, 6 Drawing Sheets

400

MEMORANDUM

FROM: JOHN SMITH

DATE: JUNE 10, 2003

402

THIS MEMO IS TO NOTIFY YOU THAT WE WILL BE CONDUCTING A FIRE DRILL ON WEDNESDAY, JUNE 18TH AT 12:30 P.M. PLEASE MARK YOUR CALENDARS.

404

AS IS COMPANY POLICY, EACH EMPLOYEE MUST EVACUATE THE BUILDING DURING THE DRILL AND MEET AT THE SCHEDULED MEETING PLACE THAT HAS BEEN ASSIGNED TO YOUR WORK GROUP.

FIG. 4

SYSTEMS AND METHODS FOR REDUCING ELECTROSTATIC MEMORY

BACKGROUND

Electrophotographic printing and copying (i.e. imaging) devices include photoconductor members on which latent images are formed for the purpose of developing toner images that can be transferred to appropriate recording media, such as pieces of paper. During printing of a received print job or a scanned document, the photoconductor member is first uniformly electrically charged by an appropriate charging apparatus, such as a charge roller. Next, portions of the photoconductor member are then discharged, for instance by laser pulses, such that toner particles provided by a developing apparatus, such as a developing roller, will be attracted to the portions of the photoconductor member that were not discharged, which correlate to print content (text and/or graphics) that is to be printed.

When print content is repeated on several consecutive pages, the photoconductor member can develop an electrostatic "memory" of the repeated content. Specifically, electrostatic charges representative of the repeated print content may remain on the photoconductor member after toner transfer, resulting in relatively light, yet noticeable, images of the print content being transferred to pages that are subsequently printed but that are not supposed to include that content. For example, when a large document that includes a logo that is provided at the top of each page is printed, a ghost image of the logo may appear on pages of another document that is subsequently printed. In similar manner, if a large number of copies of a given single-page document are generated using a photocopier, a ghost image of the document content may appear on other hardcopy documents that are subsequently output by the photocopier.

The above-described phenomenon occurs because, when given content is repeatedly printed, a charge that represents that content builds on surface of the photoconductor member without being completely erased during the print cycle. The charge build up occurs, in part, due to the fact that the print engines of most imaging devices are operated such that the leading edge of each page of the printed document coincides with the same point on the surface of the photoconductor member. This manner of engine operation may facilitate correct alignment of the print content on the pages and/or account for the physical characteristics of the photoconductor member.

From the above, it can be appreciated that it would be desirable to have a system and a method for reducing electrostatic memory to avoid unintended printing of ghost images.

SUMMARY

Disclosed are systems and methods for reducing of electrostatic memory. In one embodiment, a system and a method pertain to determining whether print content is to be repeated across consecutive pages, and if the print content is to be repeated, controlling a print engine of the imaging device to reduce electrostatic memory on a photoconductor member of the print engine.

BRIEF DESCRIPTION OF THE DRAWINGS

The disclosed systems and methods can be better understood with reference to the following drawings. The components in the drawings are not necessarily to scale.

FIG. 4 illustrates an example printed page that indicates shifting a latent electrostatic image using the method of FIG. 3.

DETAILED DESCRIPTION

As described above, electrostatic charges representative of repeated print content may remain on a photoconductor member after printing is completed, resulting in ghost images of the repeated content being transferred to recording media (e.g., pages) that are subsequently printed by the imaging device. As is described in the following, however, such electrostatic "memory" can be reduced by adjusting the placement of the latent electrostatic images formed on the device's photoconductor member during the printing of the repeated content and/or by adjusting a print cycle to alter the reconditioning that the photoconductor member undergoes during the print process.

Figure 1:
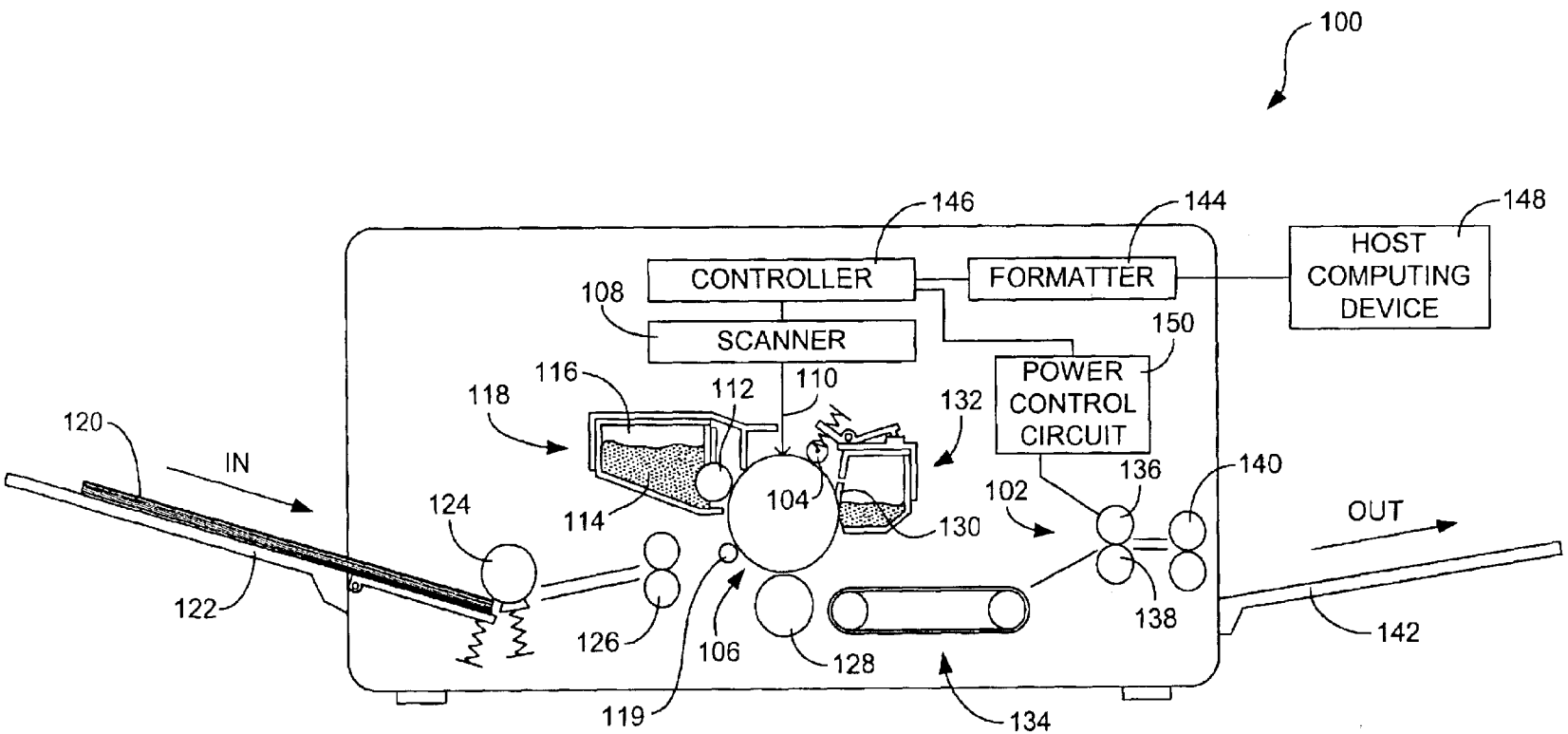
FIG. 1 is a schematic view of an embodiment of an electrophotographic imaging device that is configured to reduce electrostatic memory.

Referring now in more detail to the drawings, in which like numerals indicate corresponding parts throughout the several views, FIG. 1 illustrates a schematic view of an example electrophotographic imaging device 100. By way of example, the device 100 comprises a laser printer. The device 100 can, alternatively, comprise another type of imaging device including, for instance, a photocopier or a multifunction peripheral (MFP) device that is capable of completing various tasks such as, for example, printing, scanning, copying, faxing, emailing, etc.

As indicated in FIG. 1, the device 100 comprises a print engine that generates hardcopy documents. In situations in which the device 100 is further capable of creating photocopies, the device 100 includes a document scanner (not shown) with which a print job is generated from a hardcopy document. Regardless, the print engine includes a charging apparatus, such as a charge roller 104, that is used to charge the surface of a photoconductor member (e.g. drum) 106 to a predetermined voltage. By way of example, the photoconductor member 106 comprises an organic photoconductor (OPC). A laser diode (not shown) is provided within a laser scanner 108 that emits a laser beam 110 that is pulsed on and off as it is swept across the surface of the photoconductor member 106 to selectively discharge the surface of the photoconductor member. In the orientation shown in FIG. 1, the photoconductor member 106 rotates in the counterclockwise direction. A developing roller 112 is used to develop a latent electrostatic image residing on the surface of photoconductor member 106 after the surface voltage of the photoconductor member has been selectively discharged. The developing roller 112 develops the image using toner 114 that is, for example, stored in a toner reservoir 116 of an electrophotographic print cartridge 118.

The developing roller 112 can, for instance, include an internal magnet (not shown) that magnetically attracts the toner 114 from the print cartridge 118 to the surface of the developing roller. As the developing roller 112 rotates (clockwise in FIG. 1), the toner 114 is attracted to the surface of the developing roller and is then transferred across a gap between the surface of the photoconductor member 106 and the surface of the developing roller to develop the latent electrostatic image. Optionally, the print engine includes an erasing apparatus, such as an erase lamp 119, that is used to erase at least a portion of the latent electrostatic charge on the surface of the photoconductor member 106 after transfer of the toner to a recording medium 120.

Recording media 120, for instance sheets of paper, are loaded from an input tray 122 by a pickup roller 124 into a conveyance path of the device 100. Each recording medium 120 is individually drawn through the device 100 along the conveyance path by drive rollers 126 such that the leading edge of each recording medium is synchronized with the rotation of the region on the surface of the photoconductor member 106 that comprises the developed toner image. As the photoconductor member 106 rotates, the toner adhered to the member contacts the recording medium 120, which has been charged by a transfer roller 128, such that the toner particles are moved away from the surface of the photoconductor member and onto the surface of the medium. Typically, the transfer of toner particles from the surface of the photoconductor member 106 to the surface of the recording medium 120 is not completely efficient. Therefore, if toner particles remain on the surface of the photoconductor member 106, those toner particles are removed by a cleaning blade 130 and deposited in a toner waste hopper 132. As the recording medium 120 moves along the conveyance path past the photoconductor member 106, a conveyer 134 may deliver the recording medium to a fusing system 102 that, for example, comprises a fuser roller 136 and a pressure roller 138 that apply heat and pressure to the recording medium 120 so as to fuse the toner to the surface of the recording medium. After fusing is completed, output rollers 140 draw the recording medium 120 out of the fusing system 102 and deliver the medium to an output tray 142.

As identified in FIG. 1, the device 100 further includes a formatter 144 and an imaging device controller 146. The formatter 144 comprises logic that acts as an image processor and therefore receives print data, such as a display list, vector graphics, or raster print data (e.g., transmitted from a host computing device 148) and converts the print data into a stream of print data that is sent to the controller 146. As is described in greater detail below, the logic of the formatter 144 can be used to reduce the production and/or presence of electrostatic memory. The formatter 144 and the controller 146 exchange data necessary for controlling the electrophotographic imaging process, and the controller supplies the stream of print data to the laser scanner 108. The print data stream sent to the laser diode within the laser scanner 108 pulses the laser diode to create the latent electrostatic image on the photoconductor member 106.

In addition to providing the print data stream to the laser scanner 108, the controller 146 controls a high voltage power supply (not shown) that supplies voltages and currents to the components used in the device 100 including the charge apparatus 104, the developing roller 112, and the transfer roller 128. The controller 146 further controls a drive motor (not shown) that drives the printer gear train (not shown) as well as the various clutches and feed rollers (not shown) necessary to move recording media 120 through the conveyance path of the device 100. A power control circuit 150 controls the application of power to the fusing system 102.

Figure 2:
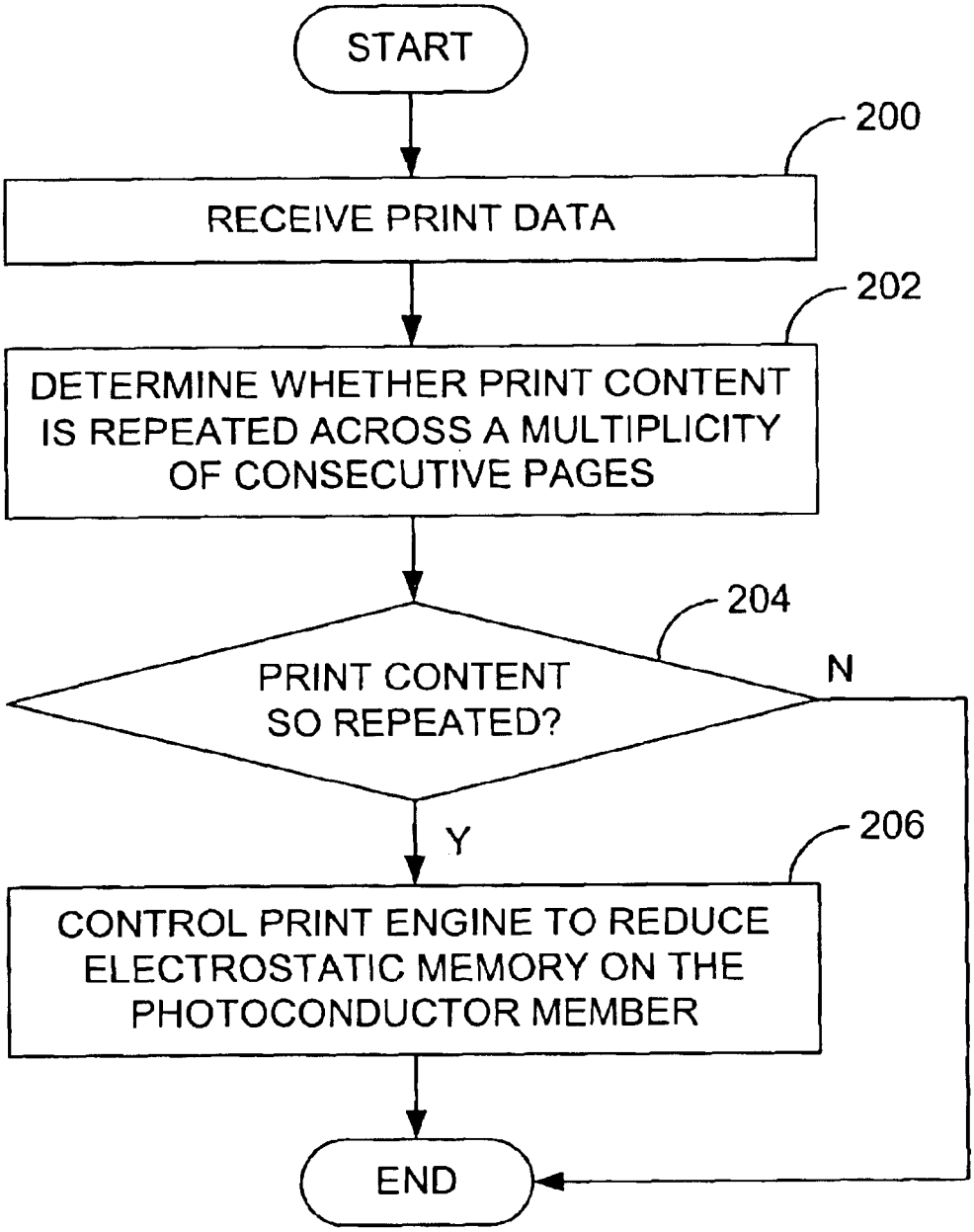
FIG. 2 is a flow diagram of an embodiment of a method for reducing electrostatic memory.

FIG. 2 is a flow diagram that illustrates a method for reducing electrostatic memory. More particularly, FIG. 2 is a flow diagram that provides an overview of operation of a formatter (e.g., formatter 144) in controlling operation of a print engine so as to reduce electrostatic memory of repeated content on the surface of a photoconductor member (e.g., member 106) so as to likewise reduce of ghost images. Process steps or blocks in the flow diagrams of this disclosure may represent modules, segments, or portions of code that include one or more executable instructions for implementing specific logical functions or steps in the process. Although particular example process steps are described, alternative implementations are feasible.

Beginning with block 200 of FIG. 2, the imaging device formatter receives print data that is to be used to generate hardcopy documents. The print data can comprise print data from one or more print jobs that were transmitted from a host device (e.g., personal computer (PC)) and/or print data from one or more print jobs that were created within the imaging device after an existing hardcopy document was scanned for the purpose of generating photocopies of the document. In either case, the formatter next determines whether print content contained in the print data is repeated across a multiplicity of consecutive pages of the document (s) that is/are to be generated, as indicated in block 202. Specifically, the formatter determines whether print content is repeated in a given location across a large number of consecutive pages that are to be printed such that there is a risk that an electrostatic memory of the print content will be created on the surface of the photoconductor member. Such a risk can be presumed if, for example, the formatter determines that repeated print content is to be printed in the same location across about 10 or more consecutive pages, although other numbers of consecutive pages may alternatively be employed.

The nature of the determination made in block 202 may depend upon the nature of the imaging device and/or the conditions under which it is being used. For example, in cases in which a print job was transmitted to the imaging device from another device (e.g., a PC), the formatter, for instance, compares the print data contained on consecutive pages of the print job to determine whether the same content, whether text or graphics, is repeated from page to page. In conducting that comparison, the formatter may qualitatively evaluate the content associated with each consecutive page to determine the content's nature and location on those pages. In other cases, the formatter may simply evaluate the pixel count and/or estimate toner usage for each page or portion of each page to identify repeated print content. Furthermore, the repeated content may comprise content of pages of consecutive print jobs to account for the situation in which content is repeated across pages of consecutively-printed documents.

In cases in which a print job was created by the imaging device from data obtained by scanning a hardcopy document (i.e. in the photocopying context), the repeated content determination may be made by, for example, first determining if a multiplicity of copies have been selected by the user and, if so, determining whether the existing document is a single-page document, thereby indicating that the exact same print content (text and/or graphics) will be repeated on the generated multiplicity of copies.

With reference to decision block 204, if the same print content is not to be repeated across a multiplicity of consecutive pages, it is unlikely that an electrostatic memory will be generated on the surface of the photoconductor member, and printing may be performed as normal without the need for further action. If, on the other hand, the same print content is to be repeated across a multiplicity of consecutive pages, the formatter controls the print engine in a manner that reduces electrostatic memory on the photoconductor member, as indicated in block 206.

As is described in greater detail below, electrostatic memory can be reduced using a variety of methods either alone or in combination. In one such method, described with reference to FIGS. 3 and 4, the formatter controls the print engine such that a latent electrostatic image of the repeated content is not applied to the photoconductor member in the same exact position for each print cycle (i.e. for each printed page). Although such operation results in a similar shifting of the print content on one or more printed pages, the content is, for example, shifted by such a small distance (e.g., a few millimeters) that the shift is not readily noticeable.

In another method, described in relation to FIG. 5, at least one print cycle is modified by the formatter so as to provide a greater opportunity for erasure of latent electrostatic images associated with the printed content to avoid and/or reverse build up of charges representative of that content. In such a method, the formatter can, for example, create print pauses during which pages are not printed but other aspects of the print process are still performed such as charging and/or erasing of the photoconductor member.

Figure 3:
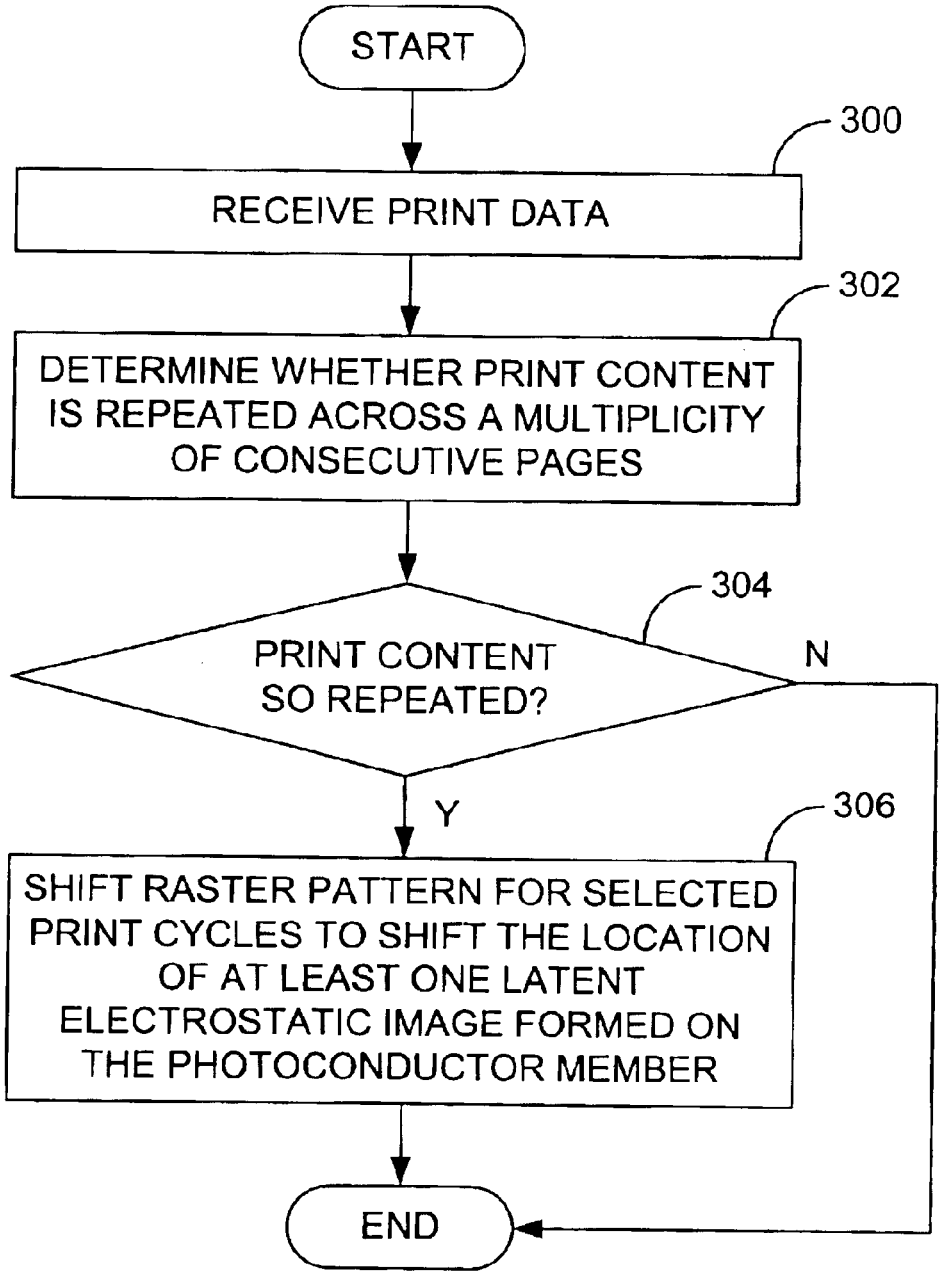
FIG. 3 is a flow diagram of an embodiment of a method for reducing creation of electrostatic memory in which a latent electrostatic image of repeated print content is formed at different positions on a photoconductor member during printing.

FIG. 3 is a flow diagram that describes a method for reducing electrostatic memory in which the formatter controls the print engine such that a latent electrostatic image of repeated content is not applied to the photoconductor member in the same exact position for each print cycle. Beginning with block 300 of FIG. 3, the imaging device formatter receives print data that is to be used to generate one or more hardcopy documents. As described above in relation to FIG. 2, the print data can comprise data from one or more print jobs that were transmitted from another device and/or data from one or more print jobs that were created within the imaging device after an existing hardcopy document was scanned for the purpose of generating multiple copies of the document. Notably, if print data from consecutive print jobs is to be compared, the imaging device formatter may need to store print data from a previously completed print job (e.g., in a buffer) so that that data will be available for comparison with the print data of a presently-printing job.

Next, the formatter determines whether print content contained in the print data is repeated across a multiplicity of consecutive pages of the document(s) that is/are to be generated, as indicated in block 302. Various examples of the manner in which that determination can be made are described above in relation to FIG. 2. With reference to decision block 304, if the same print content is not to be so repeated, the formatter need not take further steps to reduce electrostatic memory of the repeated content.

Referring next to block 306, if print content is to be repeated across a multiplicity of consecutive pages, the formatter (in the embodiment of FIG. 3) then shifts the raster pattern for selected print cycles during the print process to shift the location of at least one latent electrostatic image formed on the photoconductor member. In particular, the raster pattern applied to the photoconductor member is shifted relative to other raster patterns applied to the photoconductor member in one of a forward, a rearward, a left, and a right direction such that the latent electrostatic image associated with the repeated content is displaced a small distance (eg., 1–5 millimeters) along the surface of the photoconductor member relative to other latent electrostatic images that were or will be formed on the member. Therefore, the electrostatic image is laid down on the photoconductor member in the usual manner although the image is shifted by a relatively small offset. By shifting the raster pattern in this manner, an electrostatic image representative of the repeated content is not formed at the exact same location on the surface of the photoconductor member for each print cycle to reduce electrostatic memory of the repeated content and, therefore, avoid the generation of ghost images. The distance and the direction of image displacement may vary and is not limited to a range of 1–5 millimeters.

FIG. 4 illustrates the results of such raster shifting with reference to an example printed page 400. In this example, it is assumed that multiple copies of a single-page text document are being printed. The document can have been, for instance, transmitted to the imaging device from another device (e.g., PC) or can have been scanned by the imaging device for purposes of making copies. Assuming that say 50 copies are to be produced, it is likely that an electrostatic memory of the text content will be formed on the photoconductor member unless preventative measures are taken. To avoid creation of such electrostatic memory or facilitate its removal once created, however, one or more electrostatic images formed during selected print cycles are shifted to a small degree such that the repeated text content is shifted relative to the same text content formed during other print cycles. For example, the text content can be shifted for each print cycle (i.e. for each printed page) or for every nth print cycle (e.g., every fifth or tenth print cycle).

The result of such shifting is evident in FIG. 4. In this figure, the location of text content 402 printed on a given generated copy is indicated in dashed lines and text content 404 printed during the next consecutive print cycle is indicated in solid lines. As is apparent from FIG. 4, the text content 404 is shifted downward and to the right on the page 400 relative to the text content 402. In that this shift represents a corresponding shift of an electrostatic latent image 402 formed on the photoconductor member, it can be appreciated that the shifting results in the text content being "misaligned" or aligned out of registration on the photoconductor member as between consecutive print cycles such that the repeated text content is not formed on the photoconductor member at the same exact point during each print cycle.

The aforementioned misalignment or misregistration avoids generation of electrostatic memory on the photoconductor member surface by reducing charge build up on discrete portions of the photoconductor member surface. As can be appreciated from FIG. 4, the amount of displacement necessary to achieve the desired misalignment is slight.

To avoid continually forming shifted electrostatic images on the same point of the photoconductor member (e.g., by always shifting down and to the right as in FIG. 4), the raster shift may be applied in various directions and distances and, in some embodiments, in a randomly-generated manner. Therefore, for example, a first raster shift could displace the print content down and to the right relative to previous content, a second raster shift could displace the content up and to the left relative to the previous content, and so forth in a random pattern. In one embodiment, however, the shift distance will not exceed a maximum distance change, in any direction away from a reference (e.g., the normal) placement to limit the distance that the printed text is shifted on the printed page. In terms of text content, this distance change may, for instance, not exceed a predetermined value of, for example, approximately 2 millimeters. Other predetermined distance values may alternatively be employed.

Figure 5A:
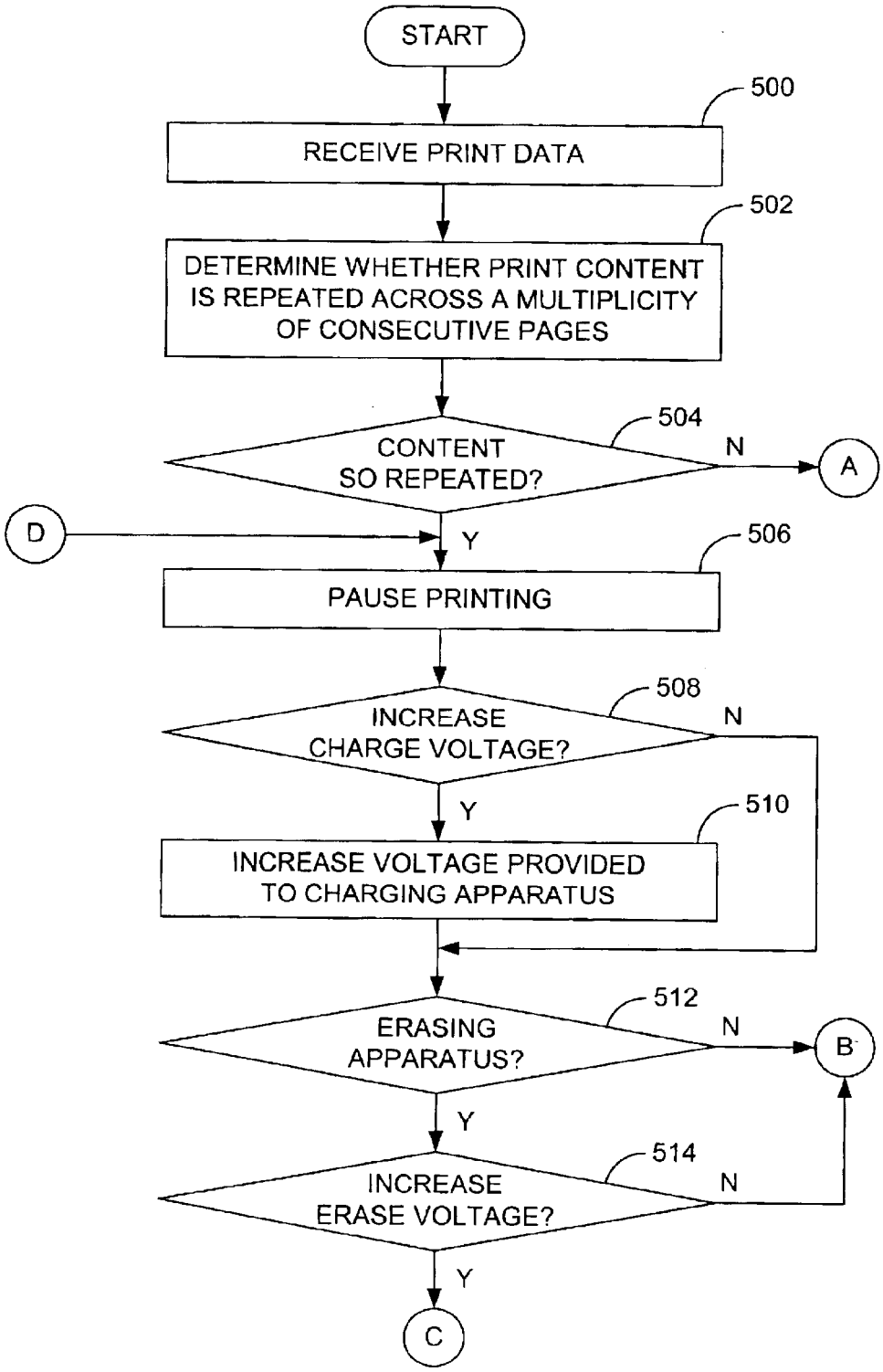
FIGS. 5A and 5B provide a flow diagram of an embodiment of a method for reducing electrostatic memory in which a print cycle is modified so as to erase electrostatic memory associated with repeated print content.
Figure 5B:
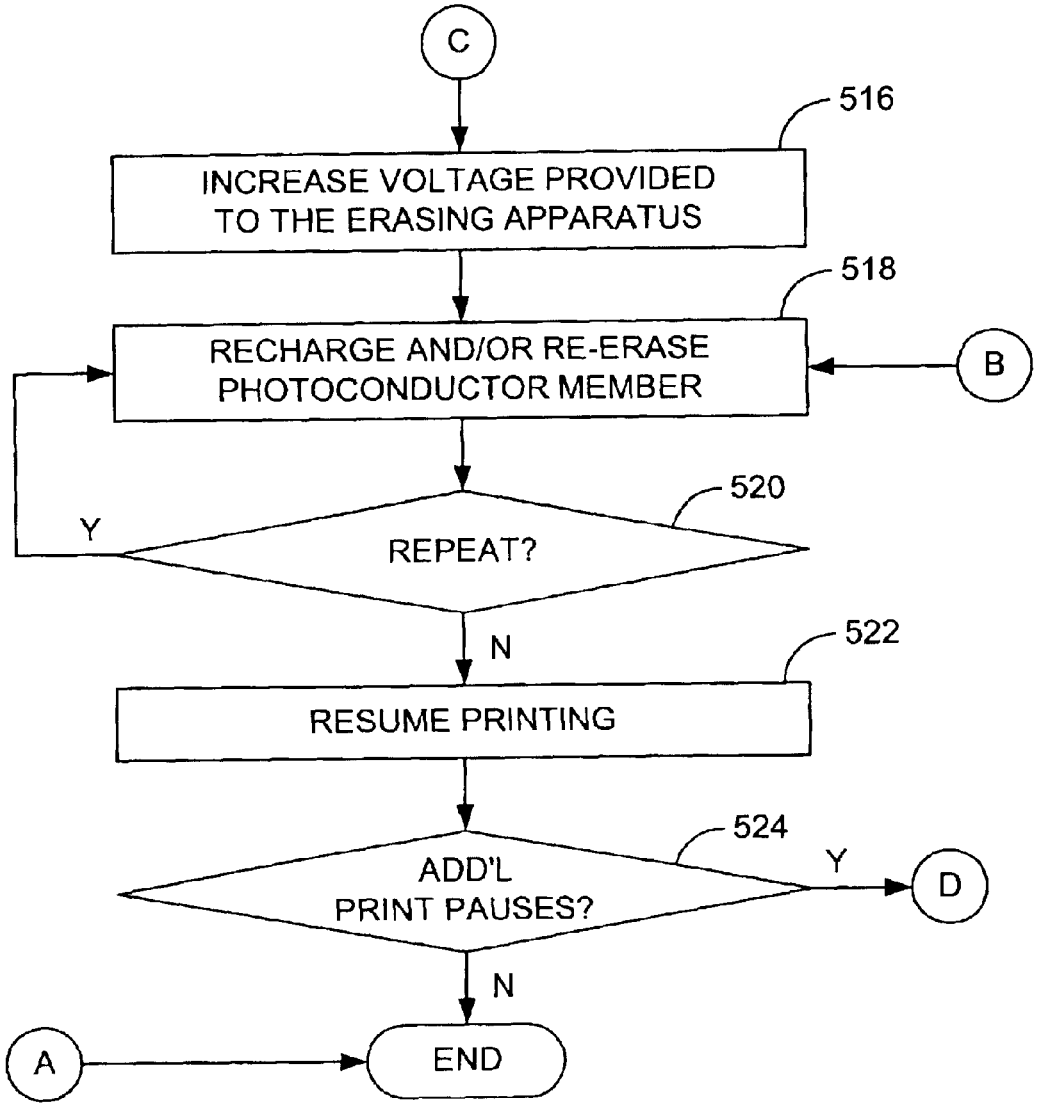

FIGS. 5A and 5B provide a flow diagram that describes a method for reducing electrostatic memory in which one or more print cycles are modified by the formatter so as to provide a greater opportunity for avoiding or erasing latent electrostatic images associated with the print repeated content. Beginning with block 500 of FIG. 5A, the imaging device formatter receives print data and, as indicated in block 502, determines whether print content contained in the print data is repeated across a multiplicity of consecutive pages of the document(s) that is/are to be generated. With reference to block 504, if no such multiplicity of consecutive pages is to be generated, no additional action need be taken by the formatter to reduce electrostatic memory.

If, on the other hand, the formatter determines that print content is repeated across a multiplicity of consecutive pages, the formatter (in the embodiment of FIGS. 5A and 5B) pauses printing, as indicated in block 506. More particularly, the printing of pages is interrupted during the print process so that, for a given period of time, printing of the document or documents is interrupted. Despite this interruption, other aspects of the print process are still performed. For instance, as is discussed in greater detail in the following, the photoconductor member is still conditioned (e.g., by charging and/or erasing charge) during the pause.

Next, with reference to decision block 508, it is determined whether the charge voltage of the charging apparatus (e.g., charge roller) is to be increased. Whether or not the charge voltage is increased depends upon the implementation in which the formatter is used. More particularly, whether or not to increase the charge voltage depends upon the capabilities of the device components (i.e. whether a higher voltage can be generated and/or whether such a voltage would damage device components) and/or whether such a charge voltage increase would be appropriate under the current printing conditions. If charge voltage increase is deemed appropriate, a relatively large magnitude charge is formed on the surface of the photoconductor member to obtain a more even charge distribution across the member that, in effect, erases any electrostatic memory of repeated content. The magnitude of the increase may depend upon the implicated imaging device and/or the conditions in which it is operated. By way of example, however, if the direct current (DC) voltage (i.e. pulsed DC voltage) or alternating current (AC) voltage (i.e. root mean square (RMS) voltage) applied to the charging apparatus is in the range of approximately −800 to −1000 volts (V) during normal printing, the increased voltage can, for instance, be in the range of approximately −1200 to −1400 V.

In addition to the above-stated considerations for the determination made at decision block 508, whether the charge voltage is increased may depend upon the present configuration of the imaging device, user selection, or the underlying print content. In some cases, increased charging of the photoconductor member may be necessary to erase the electrostatic memory in that such content may not be removed without such increase.

Returning to decision block 508, if no such increase is to be provided, flow continues down to decision block 512 discussed below. If the charge voltage is to be increased, however, it is increased a predetermined amount for the duration of the print pause, as indicated in block 510.

Referring to decision block 512, flow next depends upon whether the imaging device includes an erasing apparatus, such as an erase lamp. If not, flow continues to block 518 of FIG. 5B. If so, however, flow continues to decision block 514 at which it is determined whether to increase the erase voltage. In the affirmative case, the voltage provided to the erasing apparatus can be increased to, thereby increase the likelihood of erasing an electrostatic memory that pertains to repeated content. The magnitude of the increase may depend upon the implicated imaging device and/or the conditions in which it is operated. By way of example, however, if the DC or AC voltage applied to the erasing apparatus is in the range of approximately 300–350 V during normal printing, the increased voltage can, for instance, be in the range of approximately 450–500 V.

Whether such an increase is to occur may, in similar manner to the determination made in decision block 508, depend upon the configuration of the imaging device, user selection, or the underlying print content. If no such increase is to be provided, flow continues to block 518 of FIG. 5B. If the erase voltage is to be increased, however, flow continues to block 516 of FIG. 5B at which the voltage that is provided to the erasing apparatus is increased to an appropriate amount for the duration of the print pause.

Next, with reference to block 518, the photoconductor member is recharged and/or re-erased so as to reduce any electrostatic memory that pertains to the repeated content. Specifically, the photoconductor member, and possibly various other print engine components (e.g., charge roller), continue to rotate such that a further charge cycle and/or a further erase cycle is performed (depending upon the results of decision blocks 508 and 514). Due to these additional cycles, irrespective of whether the charge or erase voltages are increased, greater uniformity of charge across the photoconductor member can be achieved. With reference to block 520, the charge and/or erase cycles may be repeated during the print pause. For instance, 14 such charge and/or erase cycles may be performed during the print pause to ensure that a uniform charge is developed across the photoconductor member. In other cases, greater or fewer charge and/or erase cycles may be adequate. Therefore, the number of charge and/or erase cycles will depend upon the particular imaging device in which the charging and erasing is performed. The particular number of cycles required may depend upon, for example, the characteristics of the photoconductor member, the charge roller, the scanner, and the erase lamp. Optionally, the number of cycles can be modified by a user as a user setting through entry of a selection via a device control panel. If the charge and/or erase cycle is to be repeated, flow returns to block 518 described above. If not, flow continues on to block 522.

Once all additional charge and/or erase cycles have been performed, printing is resumed, as indicted in block 522. In particular, the normal print process, using the normal operating conditions (including charge and/or erase voltages) is resumed and further pages are passed through the print path so as to transfer toner from the photoconductor member to the pages. Next, the formatter determines in decision block 524 whether further print pauses are necessary. This determination may be made in relation to the number of consecutive pages that are to include the same print content. Optionally, several print pause cycles may be performed. For instance, such a print pause may be implemented for every 10–20 consecutive pages that contain the same print content. If further print pauses are warranted (e.g., for long documents and/or many copies), flow returns to decision block 506 of FIG. 5A at which the above-described process is repeated. If not, however, flow for the session is terminated.

What is claimed is:

1. A method for reducing electrostatic memory in an imaging device, the method comprising:

determining whether print content is to be repeated across consecutive pages; and if the print content is to be repeated, controlling a print engine of the imaging device to reduce electrostatic memory on a photoconductor member of the print engine;

wherein determining whether print content is to be repeated comprises evaluating a pixel count of at least portions of consecutive pages that are to be printed.

2. A method for reducing electrostatic memory in an imaging device, the method comprising:

determining whether print content is to be repeated across consecutive pages; and if the print content is to be repeated, controlling a print engine of the imaging device to reduce electrostatic memory on a photoconductor member of the print engine;

wherein determining whether print content is to be repeated comprises estimating toner usage for at least portions of consecutive pages that are to be printed.

3. A method for reducing electrostatic memory in an imaging device, the method comprising:

determining whether print content is to be repeated across consecutive pages; and if the print content is to be repeated, controlling a print engine of the imaging device to reduce electrostatic memory on a photoconductor member of the print engine;

wherein controlling a print engine of the imaging device to reduce electrostatic memory comprises forming a latent electrostatic image of the repeated content on the photoconductor member at a position that is different from a position at which a previous latent electrostatic image representing the repeated content was formed on the photoconductor member;

wherein forming a latent electrostatic image of the repeated content comprises shifting a raster pattern for at least one selected print cycle of a print process performed by the imaging device; and wherein shifting a raster pattern results in a latent electrostatic image of the repeated content being formed on the photoconductor member that is out of registration with the previous latent electrostatic image formed on the photoconductor member by no more than approximately 5 millimeters.

4. A method for reducing electrostatic memory in an imaging device, the method comprising:

determining whether print content is to be repeated across consecutive pages; and if the print content is to be repeated, controlling a print engine of the imaging device to reduce electrostatic memory on a photoconductor member of the print engine;

wherein controlling a print engine of the imaging device to reduce electrostatic memory comprises pausing printing during the print process while reconditioning the photoconductor member.

5. The method of claim 4, wherein determining whether print content is to be repeated comprises qualitatively evaluating the print content of consecutive pages that are to be printed.

6. The method of claim 4, wherein reconditioning the photoconductor member comprises charging the photoconductor member.

7. The method of claim 6, wherein charging the photoconductor member comprises charging the photoconductor member to a larger magnitude charge than the photoconductor member is charged to during printing.

8. The method of claim 4, wherein reconditioning the photoconductor member comprises erasing charge on the photoconductor member.

9. The method of claim 8, wherein erasing charge on the photoconductor member comprises erasing charge using an erasing apparatus that is provided with a voltage that is higher than a voltage applied to the erasing apparatus during printing.

10. A system for reducing electrostatic memory in an imaging device, the system comprising:

means for determining whether electrostatic memory of repeated print content is likely to be formed on a photoconductor member of the imaging device; and means for controlling a print engine of the imaging device to reduce electrostatic memory on the photoconductor member;

wherein the means for controlling comprise means for shifting the position of a raster pattern representative of the repeated content and applied to the photoconductor member relative to a raster pattern previously applied to the photoconductor member; and wherein the means for shifting the position of a raster pattern comprise means for shifting the position of a raster pattern no more than approximately 5 millimeters relative to the raster pattern previously applied to the photoconductor member.

11. A system for reducing electrostatic memory in an imaging device, the system comprising:

means for determining whether electrostatic memory of repeated print content is likely to be formed on a photoconductor member of the imaging device; and means for controlling a print engine of the imagine device to reduce electrostatic memory on the photoconductor member:

wherein the means for controlling a print engine comprises means for pausing printing while reconditioning the photoconductor member.

12. The system of claim 11, wherein the means for pausing printing while reconditioning the photoconductor member comprise means for charging the photoconductor member.

13. The system of claim 12, wherein the means for charging the photoconductor member comprise means for charging the photoconductor member to a larger magnitude charge than the photoconductor member is charged to during printing.

14. The system of claim 11, wherein the means for pausing printing while reconditioning the photoconductor member comprise means for erasing charge on the photoconductor member.

15. The system of claim 14, wherein the means for erasing charge on the photoconductor member comprise means for erasing charge using an erasing apparatus that is provided with a voltage that is higher than a voltage applied to the erasing apparatus during printing.

16. A formatter for use in an imaging device, the formatter being stored on a computer-readable medium and comprising:

logic configured to receive a print job;

logic configured to determine whether print content of the print job is to be repeated across consecutive pages; and logic configured to to pause printing while reconditioning a photoconductor member of the imaging device so as to reduce electrostatic memory on the photoconductor member.

17. The formatter of claim 16, wherein the logic configured to determine whether print content is to be repeated comprises logic configured to compare the print content of consecutive pages that are to be printed.

18. The formatter of claim 16, wherein the logic configured to control the imaging device further comprises logic configured to shift a raster pattern applied to the photoconductor member such that a latent electrostatic image is formed on the photoconductor member in a position different from a position of the photoconductor member on which a previous latent electrostatic image was formed.

19. The formatter of claim 16, wherein the logic configured to pause printing while reconditioning is configured to charge the photoconductor during the printing pause.

20. The formatter of claim 19, wherein the logic configured to pause printing while reconditioning is configured to charge the photoconductor during the printing pause to a larger magnitude charge than the photoconductor member is charged to during printing.

21. The formatter of claim 16, wherein the logic configured to pause printing while reconditioning is configured to erase charge on the photoconductor member during the printing pause.

22. The formatter of claim 21, wherein the logic configured to pause printing while reconditioning is configured to erase charge on the photoconductor member during the printing pause using an erasing apparatus that is provided with a voltage that is higher than a voltage applied to the erasing apparatus during printing.

23. An imaging device, comprising:

a photoconductor member;

a charging apparatus that charges the photoconductor member;

a scanner that selectively discharges the photoconductor member; and a formatter that receives print data and converts the print data into a stream of binary print data, the formatter being configured to determine whether print content of received print data is to be repeated across consecutive pages and, if so, control the imaging device so as to reduce electrostatic memory on the photoconductor member by at least one of charging the photoconductor member and erasing charge on the photoconductor member.

24. The imaging device of claim 23, wherein the formatter is further configured to shift a raster pattern applied to the photoconductor member such that a latent electrostatic image is formed on the photoconductor member in a position different from a position of the photoconductor member on which a previous latent electrostatic image was formed.

25. A method for reducing electrostatic memory in an imaging device, the method comprising:

determining whether print content is to be repeated across consecutive pages; and controlling a print engine of the imaging device to reduce electrostatic memory on a photoconductor member of the print engine only when it is determined that print content is to be repeated across consecutive pages.

26. The method of claim 25, wherein determining whether print content is to be repeated comprises qualitatively evaluating the print content of consecutive pages that are to be printed.

27. The method of claim 25, wherein determining whether print content is to be repeated comprises evaluating a pixel count of at least portions of consecutive pages that are to be printed.

28. The method of claim 25, wherein determining whether print content is to be repeated comprises estimating toner usage for at least portions of consecutive pages that are to be printed.

29. The method of claim 25, wherein controlling a print engine of the imaging device to reduce electrostatic memory comprises forming a latent electrostatic image of the repeated content on the photoconductor member at a position that is different from a position at which a previous latent electrostatic image representing the repeated content was formed on the photoconductor member.

30. The method of claim 29, wherein forming a latent electrostatic image of the repeated content comprises shifting a raster pattern for at least one selected print cycle of a print process performed by the imaging device.

31. The method of claim 30, wherein shifting a raster pattern results in a latent electrostatic image of the repeated content being formed on the photoconductor member that is out of registration with the previous latent electrostatic image formed on the photoconductor member by no more than approximately 5 millimeters.

32. A system for reducing electrostatic memory in an imaging device, the system comprising:

means for determining whether electrostatic memory of repeated print content is likely to be formed on a photoconductor member of the imaging device; and means, responsive to the means for determining whether electrostatic memory of repeated print content is likely to be formed, for controlling a print engine of the imaging device to reduce electrostatic memory on the photoconductor member if electrostatic memory is likely to be formed.

33. The system of claim 32, wherein the means for controlling comprise means for shifting the position of a raster pattern representative of the repeated content and applied to the photoconductor member relative to a raster pattern previously applied to the photoconductor member.

34. The system of claim 33, wherein the means for shifting the position of a raster pattern comprise means for shifting the position of a raster pattern no more than approximately 5 millimeters relative to the raster pattern previously applied to the photoconductor member.

35. A formatter for use in an imaging device, the formatter being stored on a computer-readable medium and comprising:

logic configured to receive a print job;

logic configured to determine whether print content of the print job is to be repeated across consecutive pages; and logic configured to control the imaging device so as to reduce electrostatic memory on a photoconductor member of the imaging device in cases in which the logic configured to determine whether print content is to be repeated determines that such content is to be repeated across consecutive pages.

36. The formatter of claim 35, wherein the logic configured to determine whether print content is to be repeated comprises logic configured to compare the print content of consecutive pages that are to be printed.

37. The formatter of claim 35, wherein the logic configured to control the imaging device comprises logic configured to shift a raster pattern applied to the photoconductor member such that a latent electrostatic image is formed on the photoconductor member in a position different from a position of the photoconductor member on which a previous latent electrostatic image was formed.

38. An imaging device, comprising:

a photoconductor member;

a charging apparatus that charges the photoconductor member;

a scanner that selectively discharges the photoconductor member; and a formatter that receives print data and converts the print data into a stream of binary print data, the formatter further being configured to determine whether print content of received print data is to be repeated across consecutive pages and, if so, control the imaging device so as to reduce electrostatic memory on the photoconductor member.

39. The imaging device of claim 38, wherein the formatter is configured to shift a raster pattern applied to the photoconductor member such that a latent electrostatic image is formed on the photoconductor member in a position different from a position of the photoconductor member on which a previous latent electrostatic image was formed.

* * * * *